US009350114B2

(12) United States Patent
Liang

(10) Patent No.: US 9,350,114 B2
(45) Date of Patent: May 24, 2016

(54) STRUCTURE OF NETWORK CONNECTOR

(71) Applicant: Yu-Ho Liang, New Taipei (TW)

(72) Inventor: Yu-Ho Liang, New Taipei (TW)

( * ) Notice: Subject to any disclaimer, the term of this patent is extended or adjusted under 35 U.S.C. 154(b) by 0 days.

(21) Appl. No.: 14/621,716

(22) Filed: Feb. 13, 2015

(65) Prior Publication Data

US 2016/0013584 A1 Jan. 14, 2016

(30) Foreign Application Priority Data

Jul. 9, 2014 (TW) ..... 103212142 U

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 43/26; H01R 2107/00; H01R 13/6272; H01R 24/64
USPC ..... 439/354
See application file for complete search history.

(56) References Cited

U.S. PATENT DOCUMENTS 6,612,859 B2 * 9/2003 Yeomans ..... H01R 13/65802 439/354
6,821,024 B2 * 11/2004 Bates, III ..... G02B 6/3893 385/76
7,025,636 B2 * 4/2006 Allen ..... H01R 33/97 439/357
7,540,756 B1 * 6/2009 Strahl ..... H01R 13/6272 439/344
7,621,770 B1 * 11/2009 Finizio ..... H01R 13/6275 439/354
8,267,712 B2 * 9/2012 Huang ..... H01R 43/26 439/344

* cited by examiner

*Primary Examiner* — Jean F Duverne
(74) *Attorney, Agent, or Firm* — Rosenberg, Klein & Lee

(57) ABSTRACT

A network connector structure includes a connector body and a locking structure. The connector body encloses a conduction wire. The locking structure is attachable to the connector body and includes a withdrawal prevention section and a coupling section. When the network connector structure is inserted into a socket, the withdrawal prevention section of the locking structure is received in the socket in such a way that an engagement face of the engagement section engages and abuts a projection block of the socket to prevent the network connector structure from being withdrawn from the socket. The coupling section detachably mounts the locking structure to the connector body so as to allow for easy replacement.

9 Claims, 6 Drawing Sheets

STRUCTURE OF NETWORK CONNECTOR

FIELD OF THE INVENTION

The present invention relates to a structure of a network connector, and in particular to a locking structure, wherein with an improvement made in the locking structure to achieve easy mounting and replacement of the locking structure to a connector body, being applicable to all sorts of LC series connectors or RJ series connectors.

BACKGROUND OF THE INVENTION

A conventional network connector structure commonly comprises a locking member. When the conventional network connector is inserted in a socket, the locking member engages a projection formed in an insertion hole of the socket. To remove the network connector from the socket, the locking member must be depressed to release the engagement between the locking member and the projection and then the network connector is released for free removal out of the socket.

Referring to FIG. 1, a conventional network connector structure 40 is shown, which is a unitary, integrally formed structure. The use of the conventional network connector structure 401 results in elasticity fatigue of the insertion/removal portion and loss of the function of engagement between the insertion/removal portion and the projection of the socket, or after a long term of use, the insertion/removal portion gets broken due to excessive use and again the function of engagement thereof with the projection of the socket fails. Further, the network connector structure must be replaced with a new one once elasticity fatigue or elastic arm breaking occurs. This causes a waste of time and also increases the cost, leading to unnecessary waste of time and parts.

SUMMARY OF THE INVENTION

In view of the above, an object of the present invention is to provide a network connector structure, which comprises a locking structure, so that when the network connector structure is inserted into a socket, a withdrawal prevention section is received in the socket to only allow engagement between the withdrawal prevention section and the socket to be released by pressing down a depression section of a spring arm, wherein the locking structure is attached to the connector body in a detachable manner so as to be replaced when the spring arm is broken or in a condition of elasticity fatigue by using a tool to scissor off the elasticity fatigue spring arm in combination with the withdrawal prevention section, whereby replacement is only necessary for the locking structure of the network plug of the present invention, without the need to replace the entire network plug and waste the entire product and cost.

To achieve the above object, the present invention provides a network connector structure that comprises a connector body and a locking structure. The connector body encloses a conduction wire. The locking structure is attachable to the connector body and comprises a withdrawal prevention section and a coupling section. The withdrawal prevention section has a front end forming an engagement section and is connected to a spring arm. An end of the spring arm that is opposite to the engagement section forms a depression section. The coupling section is configured to form an inverted U-shaped structure. When the network connector structure is inserted into a socket, the withdrawal prevention section of the locking structure is received in the socket in such a way that an engagement face of the engagement section engages and abuts a projection block of the socket to prevent the network connector structure from being withdrawn from the socket.

The locking structure further comprises a flat plate. The withdrawal prevention section is arranged on the flat plate. The spring arm is connected to the flat plate and extends in a direction away from the socket. For the locking structure of the network connector structure according to the present invention, the depression section is arranged at an end of the spring arm that is distant from the socket and the engagement section has an end elastically connected to the spring arm and an opposite end connected to the coupling section. When the network connector structure is inserted into a socket, a portion of the spring arm is located outside the socket, so that the depression section of the spring arm is depressible to release and remove the network connector structure out of the socket.

Further, the locking structure comprises a cutoff formed to correspond to the depression section. The cutoff is located between the withdrawal prevention section and the coupling section and arranged at a location under the depression section so as to allow the depression section, in a downward movement thereof, to be received therein. Further, the withdrawal prevention section further comprises a raised block formed on the engagement section. With the network connector structure being inserted into the socket, when the depression section is pressed down to release and remove the network connector structure out of the socket, the raised block 214 is caused to contact an inside top wall of the socket to prevent the withdrawal prevention section from being lifted by an excessively large angle and to help remove the network connector structure out of the socket.

For the network connector structure according to the present invention, the coupling section of the locking structure further comprises two side plates, a cross plate, two barbs and two retention members. The cross plate is arranged between the side plates and connected to the side plates so that the cross plate and the side plates, as a whole, form an inverted U-shape. The cross plate is connected to the withdrawal prevention section and the barbs are respectively connected to the side plates, whereby the barbs and the retention members function to mount the locking structure to the connector body to have the locking structure releasably attached to the connector body.

Further, the connector body further comprises a protrusion section, a stop section, and a hook section. The protrusion section is formed on a front end of the connector body. The stop section and the hook section re formed on the connector body. When the locking structure and the connector body are attached to each other, the retention members of the locking structure are coupled to the stop section of the connector body and the barbs of the locking structure are coupled to the hook section of the connector body so as to fix the locking structure and the connector body together. In other words, the locking structure is attachable to the connector body in such a way that the protrusion section of the connector body engages the engagement section of the locking structure and the stop section of the connector body engages the retention members of the locking structure. The present invention makes use of a localized modification of the structure to achieve easy installation and removal of a locking structure and a connector body and to securely fix the relative position of the two during the assembly thereof.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
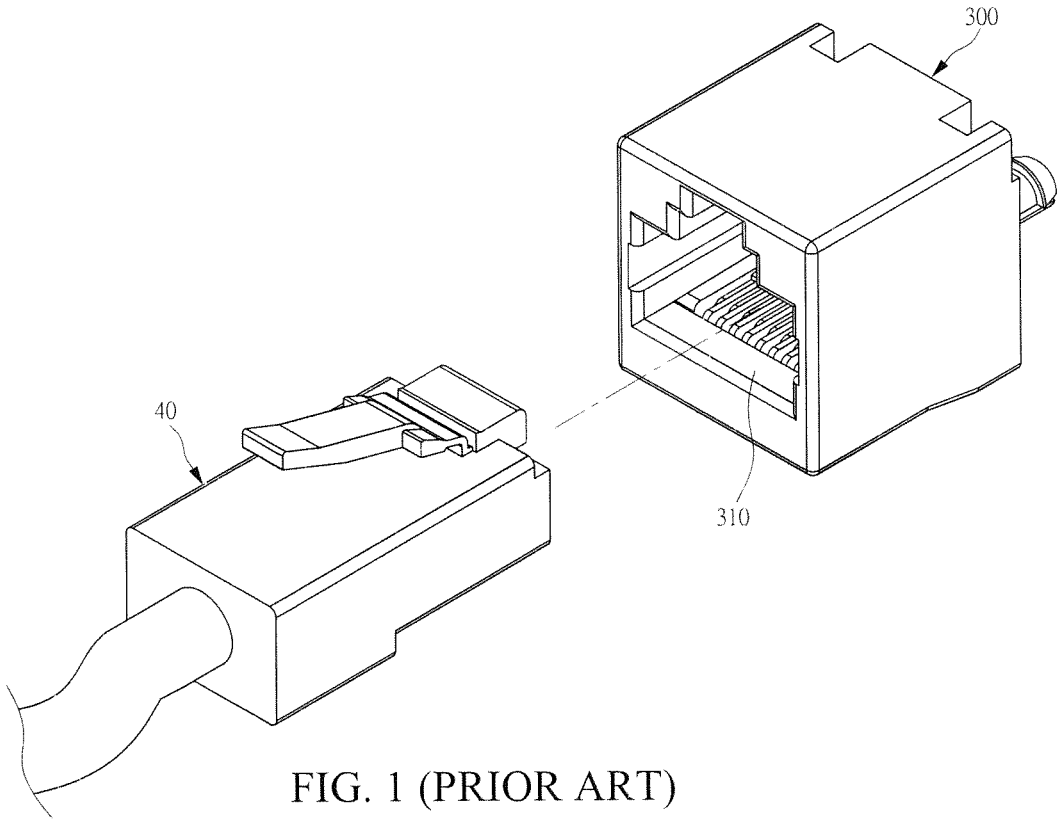
FIG. 1 (PRIOR ART)
FIG. 1 is a perspective view showing a conventional network connector structure and a corresponding socket.
Figure 2:
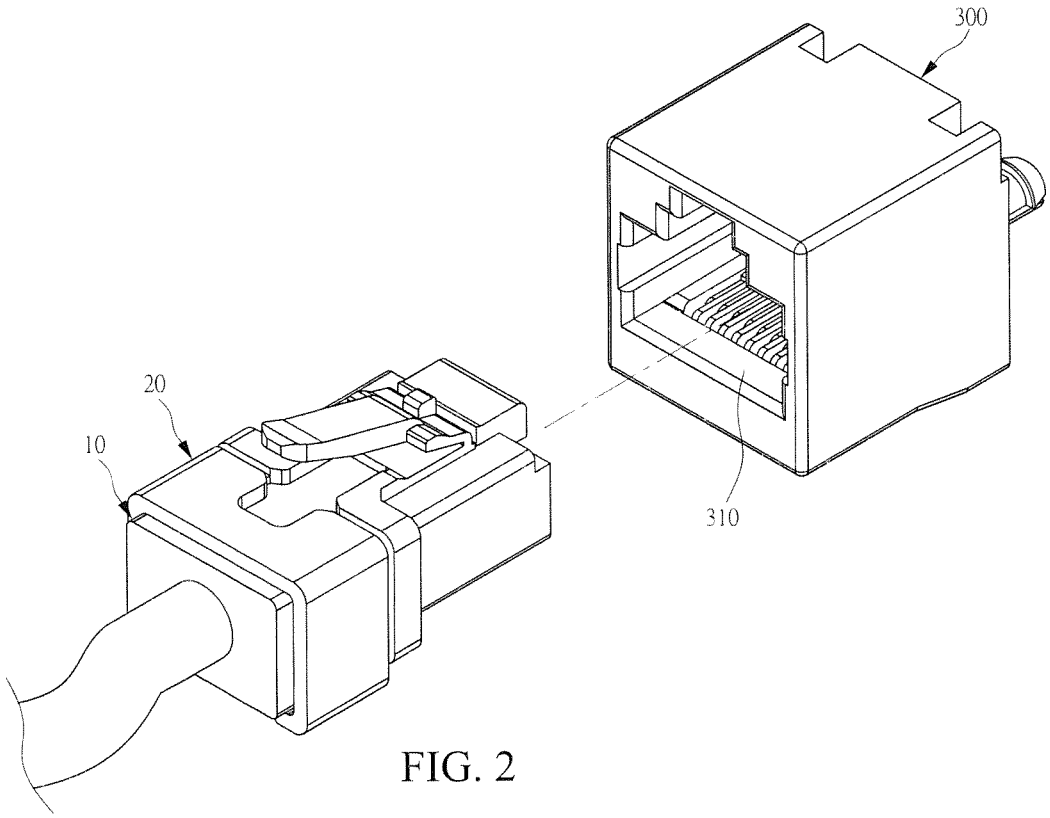
FIG. 2 is a perspective view showing a network connector structure according to the present invention and a corresponding socket.
Figure 3:
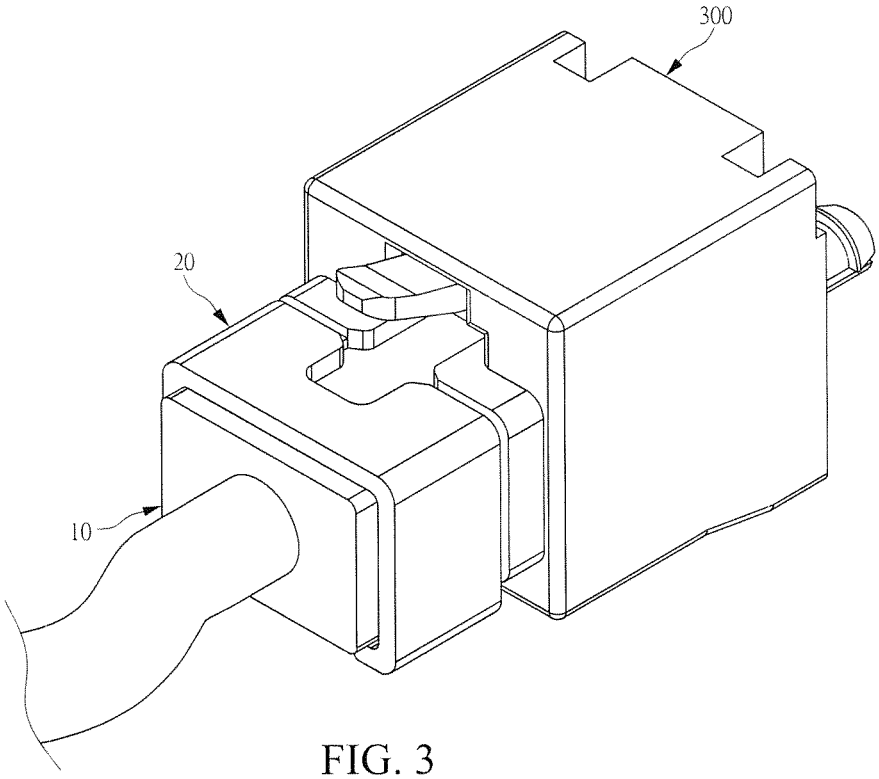
FIG. 3 is a perspective view showing the network connector structure according to the present invention mating the corresponding socket.

With reference to the drawings and in particular to FIGS. 2 and 3, which illustrate a network connector structure according to the present invention and a socket corresponding thereto, as shown in FIGS. 2 and 3, the network connector structure according to the present invention comprises at least a connector body 10 and a locking structure 20. The connector body 10 is connected to a conduction wire. The locking structure 20 is removably attached to the connector body 10. The connector body 10 is insertable into an insertion hole 310 of the socket 300.

Figure 4:
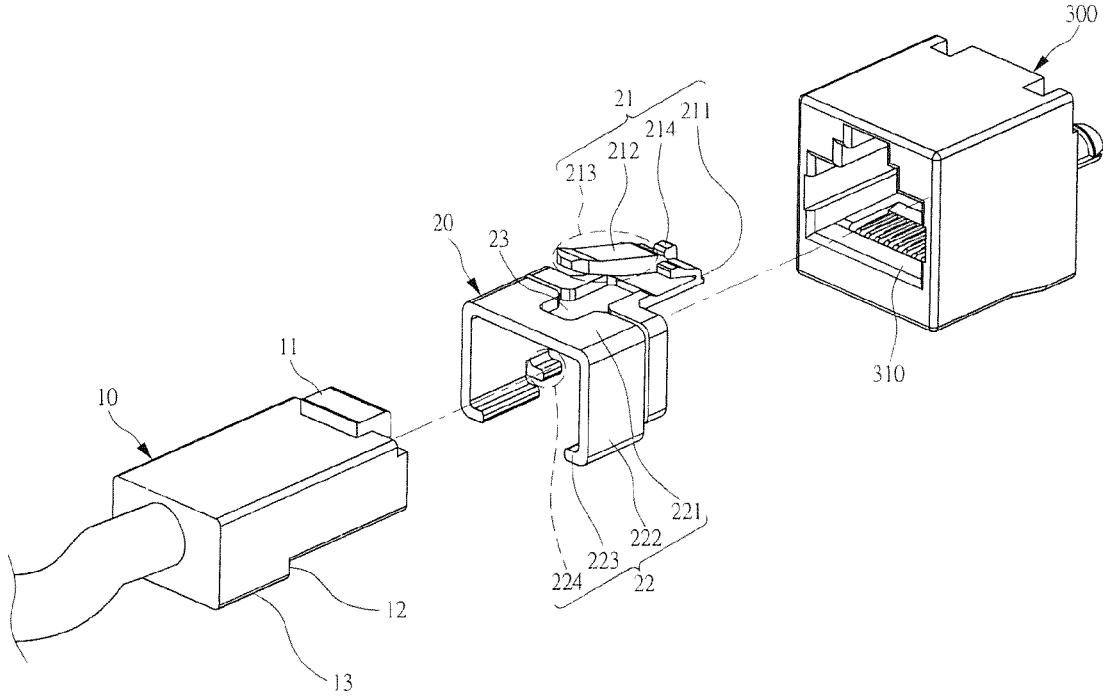
FIG. 4 is an exploded view of the network connector structure according to the present invention, showing a locking structure separated therefrom.
Figure 5:
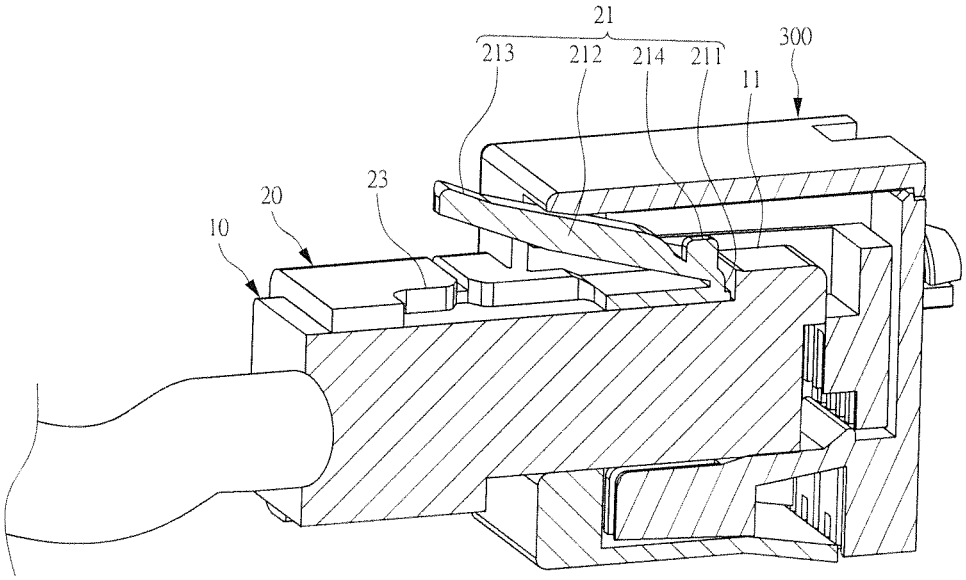
FIG. 5 is a cross-sectional view of the network connector structure with the locking structure attached thereto.

Referring to FIGS. 4 and 5, which are respectively an exploded view and a cross-sectional view of the network connector structure according to the present invention, as shown in FIGS. 4 and 5, the locking structure 20 comprises a withdrawal prevention section 21 and a coupling section 22. The withdrawal prevention section 21 has a front end that forms an engagement section 211 and is connected to a spring arm 212. An end of the spring arm 212 that is opposite to the engagement section 211 forms a depression section 213. In a practical embodiment, the coupling section 22 comprises an inverted U-shaped structure or may alternatively comprise a structure that is configured according to the requirements for practical applications thereof.

Figure 6:
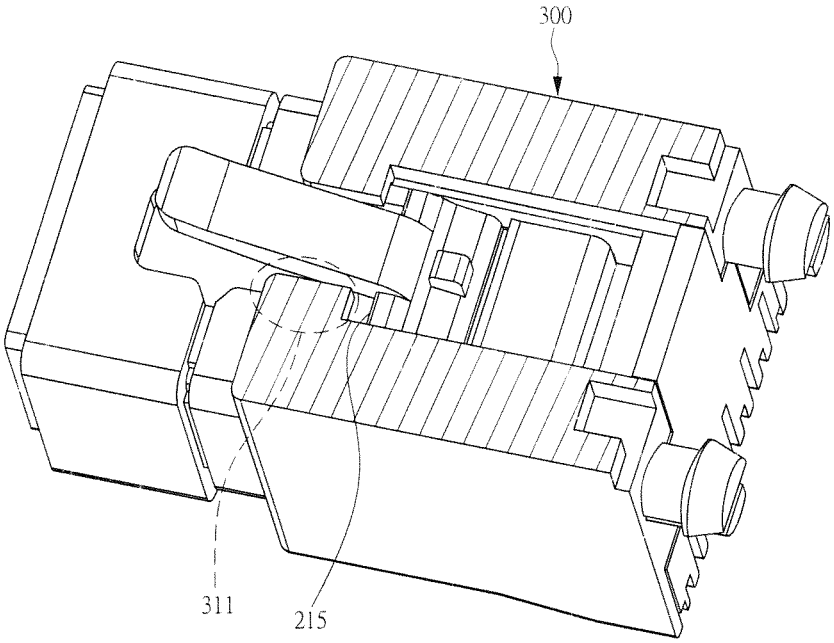
FIG. 6 is perspective view taken from the top side showing the network connector structure according to the present invention with the locking structure attached thereto.

Further, when the network connector structure is inserted and thus plugged in the socket 300, the withdrawal prevention section 21 of the locking structure 20 is received in the insertion hole 310 of the socket 300 so that an engagement face 215 of the engagement section 211 engages and abuts a projection block 311 of the socket 300 to prevent the network connector structure from being pulled out of and thus withdrawn from the socket 300, as illustrated in FIG. 6, which is a perspective view of the network connector structure according to the present invention and the locking structure thereof, taken from a top side thereof.

As to the locking structure 20 of the network connector structure according to the present invention, the depression section 213 is arranged at the end of the spring arm 212 that is distant from the socket 300. The engagement section 211 has an end elastically connected to the spring arm 212 and an opposite end connected to the coupling section 22. When the network connector structure is inserted into the socket 300, a portion of the spring arm 212 is located outside the socket 300, so that the depression section 213 of the spring arm 212 is depressible from the outside to release and remove the network connector structure out of the socket.

Further, the locking structure 20 comprises a cutoff 23 formed to correspond to the depression section 213. The cutoff 23 is located between the withdrawal prevention section 21 and the coupling section 22 and is arranged at a location under the depression section 213. When the depression section 213 of the spring arm 212 is pressed down to release and remove the network connector structure from the socket, the depression section 213 of the spring arm 212 is receivable in the cutoff 23, so as to expand a movement range of the depression section 213 to allow for easier removal of the network connector structure. Further, the withdrawal prevention section 21 may further comprise a raised block 214, formed on the engagement section 211 so that with the network connector structure being inserted into the socket, when the depression section 213 is pressed down to release and remove the network connector structure out of the socket, the raised block 214 is caused to contact an inside top wall of the socket to prevent the withdrawal prevention section 21 from being lifted by an excessively large angle.

For the network connector structure according to the present invention, the coupling section 22 of the locking structure 20 may further comprise two side plates 222, a cross plate 221, two barbs 223, and two retention members 224. The cross plate 221 is arranged between the side plates 222 and connected to the side plates 222. In the instant embodiment, the cross plate 221 and the side plates 222 of the coupling section 22 collectively define the inverted U-shaped structure. The cross plate 221 is connected to the withdrawal prevention section 21. The barbs 223 are respectively connected to an end of the side plates 222 that is adjacent to the conduction wire. The retention members are respectively connected to another end of the side plates 222 that is distant from the conduction wire. The barbs 223 and the retention members 224 function to mount the locking structure 20 to the connector body 10 in such a releasable way as to allow the locking structure 20 to selectively attached to or detached from the connector body 10.

Further, the connector body 10 may further comprise a protrusion section 11, a stop section 12, and a hook section 13. The protrusion section 11 is formed on an end of the connector body 10 that faces the insertion hole 300. The stop section 12 and the hook section 13 are formed on the connector body 10. When an attempt is made to attach the locking structure 20 and the connector body 10 to each other, the retention members 224 of the locking structure 20 and the stop section 12 of the connector body 10 are set in abutting engagement with each other and the barbs 223 of the locking structure 20 engage and grip the hook section 13 of the connector body 10 so as to fix the locking structure 20 and the connector body 10 together. In an alternative embodiment, the locking structure 20 and the connector body 10 are to be attached to each other, the protrusion section 11 of the connector body 10 engages and abuts the engagement section 211 of the locking structure 20 and the stop section 12 of the connector body 10 engages and abuts the retention members 224 of the locking structure 20.

The present invention provides an improvement of the entire structure to securely fix the positions between the two and split the network connector structure into a locking structure 20 and a connector body 10, so that in a practical use, easy installation and removal can be achieved, allowing only the locking structure 20 to be replaced when it intends to repair or replace the network connector structure. As such, the network connector structure according to the present invention actually achieves the advantages of saving cost and easy installation and removal.

Further, in practical applications, the locking structure 20 may additionally comprises a flat plate and the withdrawal prevention section 21 is arranged on the flat plate and the spring arm 212 is connected to the flat plate and extends in a direction away from the socket 300. The spring arm 212 can be improved in, respect of the length of according to the practical uses.

In the above, embodiments, the present invention provides a locking structure 20 that is detachably attached to the connector body 10.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A network connector structure, at least comprising:

a connector body, which encloses a conduction wire; and a locking structure, which is attachable to the connector body and comprises a withdrawal prevention section and a coupling section, the withdrawal prevention section having a front end forming an engagement section and connected to a spring arm, an end of the spring arm that is opposite to the engagement section forming a depression section, the coupling section being configured to form an inverted U-shaped structure;

wherein when the network connector structure is inserted into a socket, the withdrawal prevention section of the locking structure is received in the socket in such a way that t an engagement face of the engagement section engages and abuts a projection block of the socket to prevent the network connector structure from being withdrawn from the socket;

wherein the withdrawal prevention section of the locking structure further comprises a raised block, the raised block being formed on the engagement section.

2. The network connector structure as claimed in claim 1, wherein the locking structure further comprises a flat plate, the withdrawal prevention section being arranged on the flat plate, the spring arm being connected to the flat plate and extending in a direction away from the socket.

3. The network connector structure as claimed in claim 1, wherein the depression section is arranged at an end of the spring aim that is distant from the socket, the engagement section having an end elastically connected to the spring arm and an opposite end connected to the coupling section.

4. The network connector structure as claimed in claim 1, wherein the coupling section further comprises two side plates, a cross plate, two barbs and two retention members, the cross plate being arranged between the side plates and connected to the side plates to form an inverted U-shape, the cross plate being connected to the withdrawal prevention section, the barbs being respectively connected to the side plates, whereby the barbs and the retention members function to mount the locking structure to the connector body to have the locking structure releasably attached to the connector body.

5. The network connector structure as claimed in claim 4, wherein the connector body further comprises a protrusion section, a stop section, and a hook section, the protrusion section being formed on a front end of the connector body.

6. The network connector structure as claimed in claim 5, wherein the locking structure is attachable to the connector body in such a way that the retention members of the coupling section are coupled to the stop section of the connector body and the barbs of the coupling section are coupled to the hook section of the connector body so as to fix the locking structure and the connector body together.

7. The network connector structure as claimed in claim 5, wherein the locking structure is attachable to the connector body in such a way that the protrusion section of the connector body engages the engagement section of the locking structure and the stop section of the connector body engages the retention members of the coupling section.

8. The network connector structure as claimed in claim 1, wherein the locking structure comprises a cutoff formed to correspond to the depression section, the cutoff being located between the withdrawal prevention section and the coupling section and arranged at a location under the depression section so as to allow the depression section, in a downward movement thereof, to be received therein.

9. The network connector structure as claimed in claim 1, wherein the withdrawal prevention section of the locking structure is formed integrally.

* * * * *